US005377809A

United States Patent [19]

Ibarrola

[11] Patent Number: 5,377,809

[45] Date of Patent: Jan. 3, 1995

[54] COIN CONTROL SYSTEMS FOR AUTOMATIC MACHINES

[75] Inventor: Jesus E. Ibarrola, Pamplona Navarra, Spain

[73] Assignee: Azkoyen Industrial, S.A., Peralta, Spain

[21] Appl. No.: 838,701

[22] PCT Filed: Jul. 10, 1991

[86] PCT No.: PCT/ES91/00042

§ 371 Date: May 5, 1992

§ 102(e) Date: May 5, 1992

[87] PCT Pub. No.: WO92/01271

PCT Pub. Date: Jan. 23, 1992

[30] Foreign Application Priority Data

Jul. 12, 1990 [ES] Spain ..... 9001908

[51] Int. Cl.[6] ..... G07D 5/08

[52] U.S. Cl. ..... 194/317; 453/3

[58] Field of Search ..... 194/217, 218, 317; 453/3, 16, 17

[56] References Cited

U.S. PATENT DOCUMENTS 4,347,924 9/1982 Hayashi et al. .

4,763,769 8/1988 Levasseur ..... 194/217

4,883,158 11/1989 Kobayashi et al. ..... 194/217

FOREIGN PATENT DOCUMENTS 0076640 4/1983 European Pat. Off. .

2651105 5/1978 Germany .

3247019 6/1984 Germany .

3924247 1/1990 Germany .

*Primary Examiner*—F. J. Bartuska

*Attorney, Agent, or Firm*—Helfgott & Karas

[57] ABSTRACT

A control system for coin-operated automatic machines is accommodated within a frame box of a rectangular prismatic and vertically elongated shape, such that in the upper part thereof there is established an electronic coin selector. Immediately below the selector is arranged a classifier, which is aided by a display and a set of buttons, whilst in the lower area of the frame box, below the classifier, there are established a series of storage tubes corresponding to respective return mechanisms. A module for temporary storage of coins, and at least one slot in one of the side walls of the frame box are provided to allow optional coupling of an external return device which, through a guide, supplies the coins to a return duct.

3 Claims, 1 Drawing Sheet

COIN CONTROL SYSTEMS FOR AUTOMATIC MACHINES

OBJECT OF THE INVENTION

The present invention relates to a series of improvements introduced in coin control systems for automatic machines, that is, machines capable of supplying a product or service prior the introduction therein of a coin or collection of coins, the said improvements affecting both the coin validation systems and the systems for storing the coins and paying out prizes or returns.

BACKGROUND OF THE INVENTION

In automatic machines of the type mentioned hereinbefore, such as for example games machines, tobacco or drinks dispensing machines, etc., a series of mechanisms such as a selector for detecting the passage of each coin, verifying the validity or invalidity thereof, and, as the case may be, valuating same, a classifier to separate coins of different values, channelling same towards a different receptacle, several storage boxes for coins of different values, designed to supply the said coins again towards the outside, generally for returns or "change", means for returning the coins introduced to the user when the machine is unable to supply the desired product, etc., are absolutely necessary.

At present, all of such elements constitute a separate arrangement wherein the said elements, though functionally interrelated, are totally independent from a physical point of view, each being located in the most appropriate area of the machine and being suitably fitted thereat, this implying an extremely complex assembly, which furthermore varies from one type of machine to another, thereby complicating matters even further.

DESCRIPTION OF THE INVENTION

The improvements proposed by the invention have been designed to fully solve these problems, in such a way that the coin control system constitutes a compact device wherein the different elements comprising same can be assembled separately before definitive assembly of the whole system in any machine, the said elements adopting a rational distribution in order to achieve a smaller volume of ocupation, that is, to form a block of small dimensions, easy to install within any machine, and with optimum characteristics from a functional point of view.

More specifically, and in order to achieve the above, the improvements proposed by the invention consist in the arrangement of the different operative elements of the control system within a rectangular prismatic and vertically elongated frame box, on the upper surface whereof there is provided and fitted an electronic coin selector, the access slot thereof projecting from the upper surface of the said frame box, as does the button for returning rejected coins, a classifier being provided immediately below the electronic selector to channel the different coins which may be introduced into the system towards different return mechanisms, as also towards the general collecting box of the machine, which will be joined to the said frame box through a suitable duct. On this lower part of the frame box there is likewise provided a temporary coin storage box, which acts as a deposit for the coins introduced by the user of the machine until the latter supplies the desired product or service, returning the said coins in the event that the machine is unable to supply such product or service.

Finally, and likewise in accordance with the improvements being described, there have been provided, on the side walls of the frame box, fixing means for the outer and auxiliary return mechanisms, together with slots in the said walls to allow access of the coins into such frame box, where guides therefor are in turn provided to allow suitable channelling of the coins towards the coin return duct, thus allowing complementary storage of such coins as are frequently given as change and which on the contrary are not normally introduced directly by the users, in order to reload the respective return mechanisms.

DESCRIPTION OF THE DRAWINGS

In order to complete the description being made, and to assit a better understanding of the characteristics of the invention, a set of drawings has been added to the present specification, as an integral part thereof, where the following has been shown in an illustrative and non-limiting manner.

PREFERRED EMBODIMENT OF THE INVENTION

Figure 1:
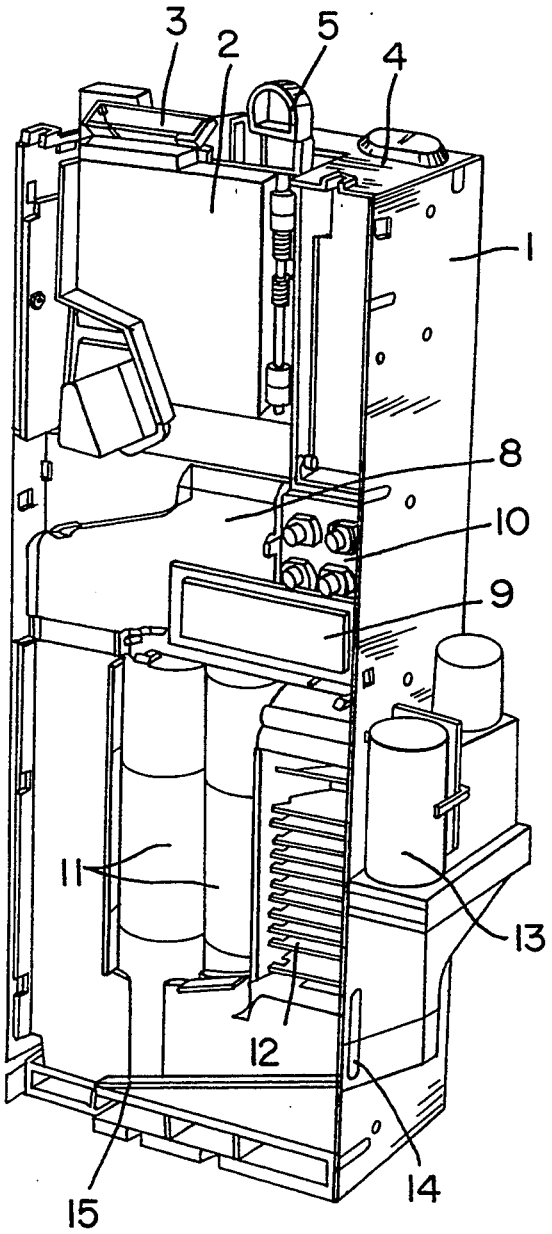
FIG. 1 shows a perspective view of a coin control system for automatic machines made in accordance with the improvements object of the present invention.
Figure 2:
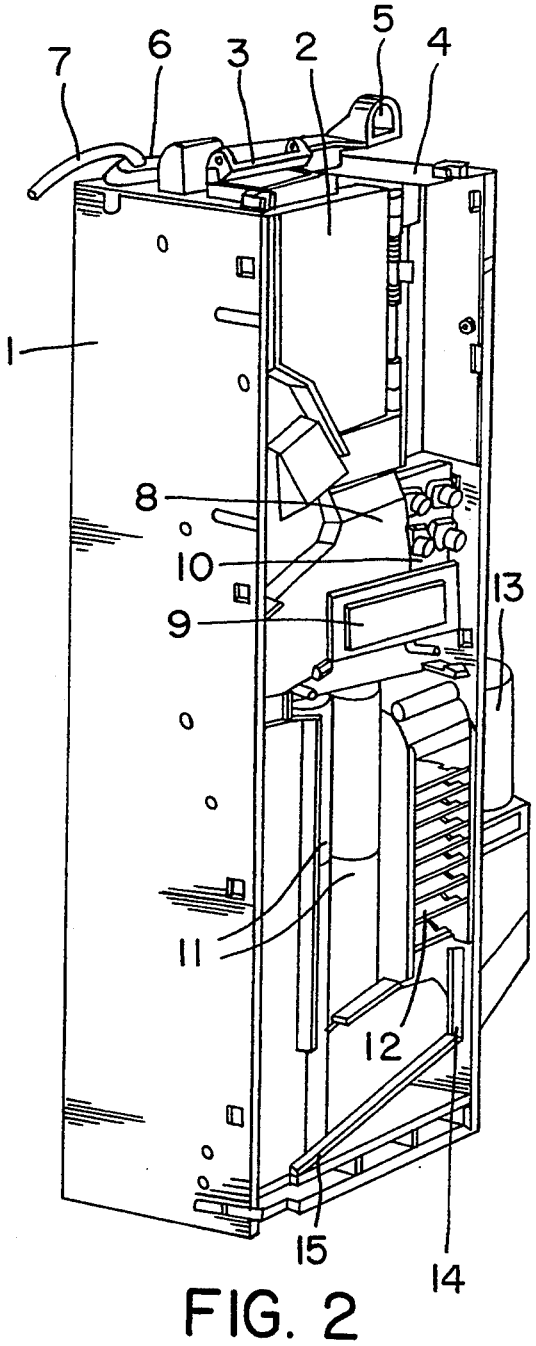
FIG. 2 shows another perspective view of the preceding figure, from a different angle.

In the light of the preceding figures, it can be observed how the coin control system in accordance with the said improvements is assembled within a frame box (1), having a prismatic rectangular and vertically elongated shape, which in the example of the preferred embodiment shown in the figures is represented without the cover which accesses the mechanisms thereof, in the upper surface of which frame (1) there is provided an electronic coin selector (2) of any conventional type, but being preferably an electronic selector, the mouth (3) whereof for access of the coins projects through a window operatively made on the upper surface (4) of the frame box, as does the button (5) for returning reject coins, there being further provided on such surface a guide (6) for cable (7) for electrical connection of the system.

The selector (2), designed to receive, select and validate the coins, identifying each of them, discharges onto a classifier (8) provided within the frame (1) immediately below same, the purpose of the classifier being obviously to deviate the coins through different channels depending on the value of same, and preferably by means of the activation of electromagnets, an alphanumeric LCD display (9) being related to this classifier, which display is capable of showing messages and allows the performance of certain functions, the said display (9) being visible through a window operatively made in the cover of the frame box, not shown in the figures, at the same time as the buttons (10) for performing the said functions likewise emerge through respective openings in the cover.

The classifier (8) unloads onto a series of tubes (11) for storing the coins, corresponding to respective returns, each of which, and as is conventional, is provided with an engine, a gear box, an eccentric, an axle, and a gate, with respect ire supports for the coin storage tube, which tube is divided into various sections, such that whilst the lower section contains a card of emptying photodiodes, the upper section contains a card of filling photodiodes, though such elements have not been shown in the figures given that, as has been said, they are conventional and can be substituted by return mechanisms of any other type.

The repeatedly mentioned cover is provided, in correspondence with tubes (11) of the return mechanisms, with vertical slots which allow visual and direct control of the number of coins present therein.

In this lower area of the frame box (1) there is established a module (12) for temporary storage of coins which, as has already been said, allows the return of the coins introduced by the user in the event that the machine should be unable to supply the desired product or service.

The said module (12) provides the advantage that it renders greater autonomy for change in the system, given that if any person introduces a coin which does not usually enter the return tubes and the machine is lacking the desired product, or, in other words, purchase of such product cannot take place, in a machine lacking this module the coins would pass into the collecting tin or box, and the user would thus be unable to recover the coins, and this does not occur with module (12), since same stores temporarily and specifically the coins which have just been introduced by the user.

In accordance with the improvements being described, it is likewise possible to provide external auxiliary return mechanisms (13), fitted externally to the side walls of the frame box (1) and being coupled to slots (14) in the said walls through which the coins are channelled towards a coin duct (15) which guides same to the return channel. Obviously, such external return mechanisms (13), given their location, cannot receive coins from selector (2) of the system, and are provided for cases in which the need to return a certain coin is foreseen to be much more frequent than the introduction of such coin into the machine by the user.

Obviously, the system likewise includes the necessary plate which controls all the elements and accounts of sales and coins collected, to subsequently download such information onto a printer or computer.

It is not considered necessary to extend the present description any further for an expert in the art to understand the scope of the invention and the advantages derived therefrom.

The materials, shape, size and arrangement of the elements may vary, provided such variation does not imply a modification in the essentiality of the invention.

The terms used to described the present specfication should be taken to have a wide and non limiting meaning.

I claim:

1. A coin control system for automatic machines, comprising a prismatic rectangular and vertically elongated frame box, a coin selector accommodated within an upper part of said frame box, a slot for introduction of coins in an upper surface of said frame box, a return button for return of rejected coins thereof and projecting through an opening provided in said upper surface of said frame box, a classifier provided in a middle section of said frame box, immediately below the coin selector, for deviating and classifying the coins received from the coin selector, an alphanumeric display disposed at the classifier and being visible through a window in said frame box for showing messages to a user, said classifier opening into a lower duct which channels the coins into a definitive collecting box, a series of vertical tubes established in a lower section of the frame box below said classifier and corresponding to respective return mechanisms, said classifier unloading into said series of vertical tubes, a module for temporary storage of coins and being accommodated in the lower section of the frame box for allowing return of the coins introduced by a user when the machine is unable to supply a desired product or service, external return mechanisms located on at least one of the side walls of the frame box, a guiding ramp and a coin return duct coupled to said external return mechanisms and accommodated below said module in said frame box, said return mechanisms unloading coins through a slot provided in one of the side walls of said frame box onto said guiding ramp which leads the coins towards said coin return duct, a closing cover, and function buttons provided on said closing covering, wherein said closing cover of said frame box further comprises openings for both visual control of the display and for acting on said function buttons and vertical slots for visual control of the contents of the vertical tubes.

2. A coin control system as claimed in claim 1, wherein the coin selector is electrical.

3. A coin control system as claimed in claim 1, wherein the classifier includes electromagnets for deviating and classifying the coins.

* * * * *